US008220286B2

(12) United States Patent
Cushman et al.

(10) Patent No.: US 8,220,286 B2
(45) Date of Patent: Jul. 17, 2012

(54) TEMPERATURE-CONTROLLED COMPARTMENT

(75) Inventors: Robert L. Cushman, Sunrise Beach, MO (US); David L. Hall, Piedmont, SC (US); Edmund Scott Richardson, Simpsonville, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 98 days.

(21) Appl. No.: 11/759,311

(22) Filed: Jun. 7, 2007

(65) Prior Publication Data

US 2008/0302125 A1 Dec. 11, 2008

(51) Int. Cl.
*F25D 17/04* (2006.01)

(52) U.S. Cl. ..... 62/407; 62/408; 62/187

(58) Field of Classification Search ..... 62/407, 62/408, 187

See application file for complete search history.

(56) References Cited

U.S. PATENT DOCUMENTS

| | | | | |
|---|---|---|---|---|
| 4,002,199 | A | 1/1977 | Jacobs | |
| 4,732,009 | A * | 3/1988 | Frohbieter | 62/89 |
| 5,212,962 | A | 5/1993 | Kang et al. | |
| 5,326,578 | A | 7/1994 | Yun | |
| 5,896,753 | A | 4/1999 | Kwak et al. | |
| 6,170,276 | B1 | 1/2001 | Mandel et al. | |
| 6,176,097 | B1 | 1/2001 | Kim | |
| 6,223,553 | B1 | 5/2001 | Albert et al. | |
| 6,343,477 | B1 | 2/2002 | Mandel et al. | |
| 6,405,548 | B1 | 6/2002 | Hollenbeck | |
| 6,463,752 | B2 | 10/2002 | Mandel et al. | |
| 6,612,116 | B2 | 9/2003 | Fu et al. | |
| 6,625,998 | B2 | 9/2003 | Kim et al. | |
| 6,655,169 | B2 | 12/2003 | Tupis et al. | |
| 6,675,603 | B1 | 1/2004 | Lesyna et al. | |
| 6,725,678 | B2 | 4/2004 | Chang et al. | |
| 6,782,706 | B2 | 8/2004 | Holmes et al. | |
| 6,802,186 | B2 | 10/2004 | Holmes et al. | |
| 6,802,369 | B2 | 10/2004 | Zentner et al. | |

(Continued)

FOREIGN PATENT DOCUMENTS

CN 1421666 6/2003

(Continued)

OTHER PUBLICATIONS

International Search Report for PCT/US2008/065195, dated Sep. 22, 2009, 2 pages.

(Continued)

*Primary Examiner* — Cheryl J Tyler
*Assistant Examiner* — Jonathan Koagel
(74) *Attorney, Agent, or Firm* — Pearne & Gordon LLP

(57) ABSTRACT

The invention concerns a storage unit that is adapted to be located in a refrigeration appliance. The storage unit includes a holding compartment for holding articles the temperature of which is to be controlled. The holding compartment is adapted to be placed in air flow communication with a source of cold air whereby the cold air may be delivered to the holding compartment. An air-flow passageway for recirculating air discharged from the holding compartment back to the holding compartment is provided along with a mixing area where the cold air and the recirculated air may be mixed in selected quantities. A user interface providing for the selection of a temperature-control procedure from a group of available temperature-control procedures for application to the interior of the holding compartment is included. The storage unit can include a controller for controlling the implementation of the temperature-control procedure selected by the user.

34 Claims, 4 Drawing Sheets

U.S. PATENT DOCUMENTS

| | | | | |
|---|---|---|---|---|
| 6,880,949 | B2 * | 4/2005 | Miozza et al. | 362/92 |
| 7,036,334 | B2 | 5/2006 | Ko et al. | |
| 7,051,549 | B2 | 5/2006 | Kim et al. | |
| 2002/0104325 | A1 | 8/2002 | Mandel et al. | |
| 2003/0097850 | A1 | 5/2003 | Chang et al. | |
| 2007/0130985 | A1 * | 6/2007 | Kalyanavaradhan et al. | 62/407 |

FOREIGN PATENT DOCUMENTS

| | | | |
|---|---|---|---|
| JP | 4244569 | | 9/1992 |
| JP | 5187756 | | 7/1993 |
| JP | 611231 | | 1/1994 |
| WO | 1221577 | A1 | 7/2002 |

OTHER PUBLICATIONS

Chinese Office Action dated Oct. 21, 2010 for Chinese patent application for 200880019146.3.

* cited by examiner

TEMPERATURE-CONTROLLED COMPARTMENT

BACKGROUND OF THE INVENTION

The present invention generally concerns storage compartments or storage units for refrigeration appliances. In particular, the invention concerns storage compartments or storage units the temperatures of which can be controlled for the purpose of controlling the temperature of articles contained in the storage compartments or storage units.

Refrigeration appliances such as refrigerators, for example, that have a fresh food section and a freezer section are known to sometimes include storage compartments or storage units whose temperatures are controlled independently of the general temperatures that are present in the fresh food section and freezer section of the refrigerator. Most often, compartments of this type are located in the fresh food section of a refrigerator and are constructed so that they may be readily accessed when the door of the fresh food compartment is opened.

In some instances, storage units of the type described are used exclusively to quickly chill articles stored within the units. In other instances, the storage units are used exclusively to thaw frozen articles stored within the units. And in some cases, the storage units are used to both quickly chill and thaw articles as desired.

BRIEF SUMMARY OF THE INVENTION

The present invention provides not only for both quickly cooling and thawing articles stored in a storage unit in a refrigeration appliance but also for maintaining articles stored in the storage unit at any temperature at which it is desired the articles be kept.

In one aspect, the invention concerns a storage unit that is adapted to be located in the fresh food section of a refrigerator having a freezer section. The storage unit includes a holding compartment having an interior for holding one or more articles the temperature of which is to be controlled. The interior of the holding compartment is adapted to be placed in air-flow communication with the freezer section of the refrigerator whereby air from the freezer section may be delivered to the interior of the holding compartment. An air flow passageway for recirculating air discharged from the interior of the holding compartment back to the interior of the of the holding compartment is provided along with a mixing area where air from the freezer section of the refrigerator and recirculated air from the interior of the holding compartment may be mixed in selected quantities. The mixing area is in air flow communication with the interior of the holding compartment. A user interface providing a group of available temperature-control procedures from which a user may select a temperature control procedure for application to the interior of the holding compartment is included. The available temperature-control procedures comprise a temperature-control procedure wherein essentially only air from the freezer section of the refrigerator is delivered to the interior of the holding compartment, a temperature-control procedure wherein essentially only recirculated air from the interior of the holding compartment is delivered to the interior of the holding compartment and a temperature-control procedure wherein essentially only a mixture of air from the freezer section of the refrigerator and recirculated air from the interior of the holding compartment is delivered to the interior of the holding compartment. The storage unit can include a controller for controlling the implementation of the temperature-control procedure selected by the user.

According to another aspect, the storage unit can include one or more of an air mover, such as a fan assembly, for moving air from the freezer section of the refrigerator to the interior of the holding compartment and for recirculating air from the interior of the holding compartment back to the interior of the holding compartment; a heating device for selectively heating and increasing the temperature of the air delivered to the interior of the holding compartment; an air flow control device that can comprise a valve arrangement for controlling the amounts of air from the freezer section of the refrigerator and recirculated air from the interior of the holding compartment that are delivered to the interior of the holding compartment; and a temperature-sensing device for providing an indication of the temperature at the interior of the holding compartment. The storage unit also can include a controller for controlling the operational variables of at least one of the fan assembly, the air flow control device, and the heating device in response to the temperature-control procedure selected by the user at the user interface, the temperature indicated by the temperature-sensing device or both the temperature-control procedure and the indicated temperature.

According to still another aspect, a storage unit for a refrigeration appliance having a source of cold air comprises a holding compartment having an interior for holding one or more articles the temperature of which is to be controlled. The holding compartment includes a first opening through which air may be introduced into the interior of the holding compartment and a second opening through which air may be discharged from the interior of the holding compartment. The storage unit further comprises an air-handling unit that includes a plenum in air flow communication with the interior of the holding compartment through the first opening in the holding compartment, whereby air may be delivered from the plenum to the interior of the holding compartment. An air inlet in the air-handling unit is adapted to be placed into air flow communication with the source of cold air in the refrigeration appliance. A first air flow passageway places the air inlet in air flow communication with the plenum, whereby air from the source of cold air in the refrigeration appliance may be selectively delivered to the interior of the holding compartment through the air inlet and the plenum. A second air flow passageway is in air flow communication with the second opening in the holding compartment for placing the second opening in air flow communication with the plenum, whereby air discharged from the interior of the holding compartment may be selectively recirculated to the interior of the holding compartment through the second air flow passageway and the plenum. An air flow control device controls the flow of air from the source of cold air in the refrigeration appliance to the plenum through the first air flow passageway and the flow of air from the second opening in the holding compartment to the plenum through the second air flow passageway. As a result, essentially only air from the source of cold air, essentially only air discharged from the interior of the holding compartment and essentially only mixtures of air from the source of cold air in the refrigeration appliance and air discharged from the interior of the holding compartment may selectively flow to the plenum and be delivered from the plenum to the interior of the holding compartment through the first opening in the holding compartment.

According to yet another aspect, the storage unit may include an air mover, such as a fan assembly, located in the air-handling unit for moving air from the source of cold air to the plenum through the air inlet and first air flow passageway, for moving air discharged from the interior of the holding compartment to the plenum through the second air flow passageway, and for the delivering air from the plenum to the interior of the holding compartment through the first opening in the holding compartment. The fan assembly can be operable so that the rate at which air is moved by the fan assembly may be adjusted. The storage unit also can include a heating device for selectively heating and increasing the temperature of the air delivered from the plenum to the interior of the holding compartment. The heating device can be operable so that the amount of heat transferred to the air may be adjusted. A temperature sensing device for providing an indication of the temperature at the interior of the holding compartment also can be provided as well as a user interface providing for selection by a user of a temperature-control procedure from a group of available temperature-control procedures for application to the interior of the holding compartment. The storage unit further can include a controller for controlling the operating variables of at least one of the fan assembly, the air flow control device, and the heating device in response to the temperature-control procedure selected by the user at the user interface, the temperature indicated by the temperature sensing device or both the temperature-control procedure and the indicated temperature.

In a further aspect, the interior of the holding compartment can be open to the interior of the refrigeration appliance so that air from the interior of the holding compartment may be discharged to the interior of the refrigeration appliance and through the second opening in the holding compartment.

DETAILED DESCRIPTION OF THE INVENTION

Figure 1:
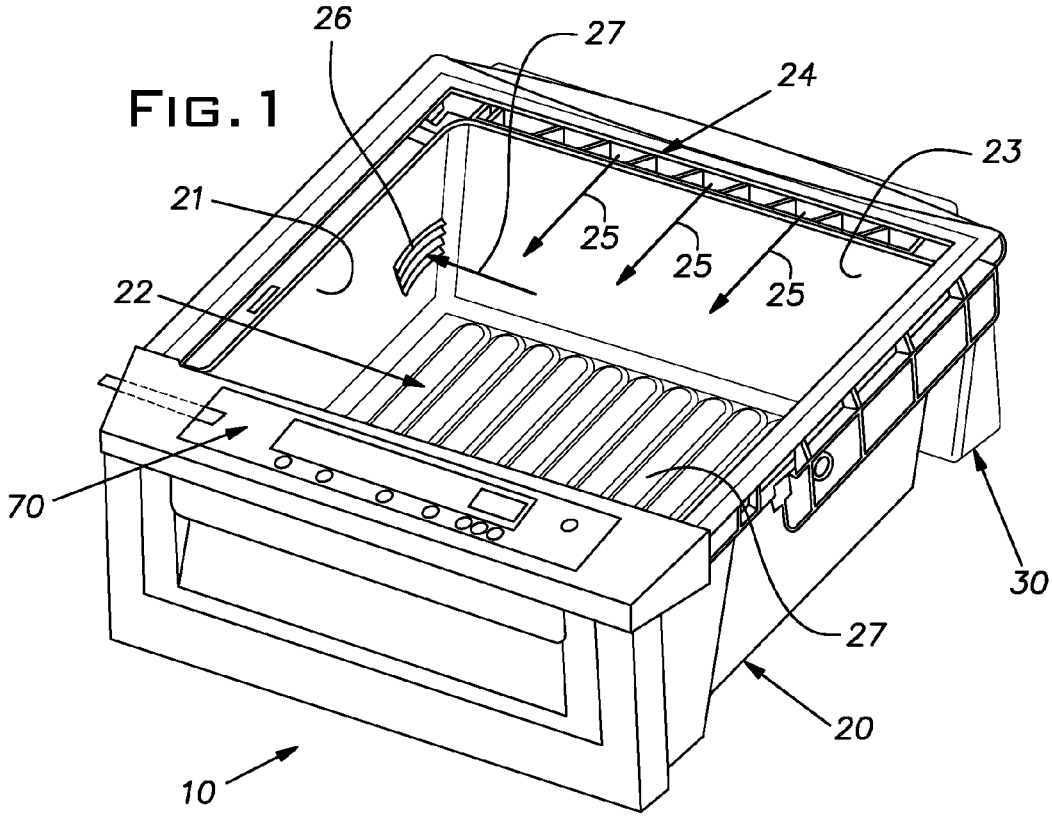
FIG. 1 is a perspective view of an embodiment of the storage unit of the invention as seen from the front of and above the storage unit.
Figure 2:
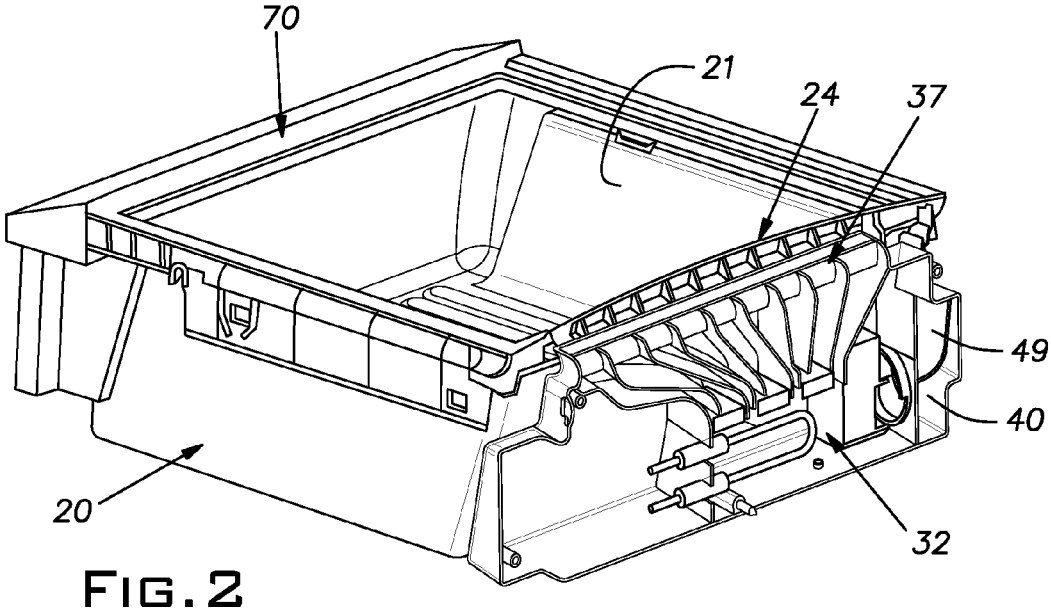
FIG. 2 is a perspective view of the storage unit embodiment of FIG. 1 as seen from the rear of and above the storage unit and showing both the holding compartment, with its rear closure plate removed, and the air-handling unit of the storage unit.

FIG. 1 illustrates an embodiment 10 of the storage unit of the invention that can be used with a refrigerator appliance, such as a house-hold refrigerator having both a fresh food section and a source of cold air such as a freezer section, and the temperature of the storage unit controlled. As shown in FIGS. 1 and 2, the embodiment of the storage unit illustrated comprises both a holding compartment 20 and an air-handling unit 30. The storage unit, when used with a house-hold refrigerator, typically would be constructed as a drawer that would be adapted to be located in the fresh food section of the refrigerator. In that case, the holding compartment 20 would be mounted on glides or rollers, for example, and supported from the side walls of the fresh food section in a manner familiar to those of ordinary skill in the art so that the holding compartment could be withdrawn from within the fresh food section whereby access can be had to the interior of the holding compartment. When in place in the fresh food section, the holding compartment would be located under a cover, not shown, made of glass for example. In the illustrated embodiment of the storage unit, the air handling unit 30 would remain in place in the fresh food section when the holding compartment 20 is withdrawn, although it is possible to have the air handling unit move with the holding compartment for the withdrawal from and the return to the interior of the fresh food compartment.

The interior 22 of the holding compartment 20 is constructed so as to hold one or more articles the temperature of which is to be controlled. Because the temperature of the storage unit, and more specifically the temperature of the interior 22 of the holding compartment 22, can be variously controlled as will become apparent from the description that follows, the storage unit can serve a variety of purposes. For example, the temperature of the storage unit can be controlled at a level below the temperature typically prevailing in the fresh food compartment in general so that the storage unit can be used to rapidly chill beverages placed in the holding compartment 20 of the storage unit. After the beverages are chilled, the temperature of the storage unit can be adjusted and controlled so as to maintain the temperature of the beverages at a desired level suitable for consumption. Alternatively, frozen foods can be placed in the holding compartment 22 of the storage unit 10 and the temperature of the storage unit can be controlled at a level greater than the temperature typically prevailing in the fresh food compartment so as to thaw the frozen foods. After the frozen foods have thawed, the temperature of the storage unit can be adjusted and maintained at a desired level so as to keep the thawed foods from spoiling until they are used. It will be understood from the description that follows that the temperature of the storage unit can be controlled not only to quickly chill or thaw articles but also to maintain the storage unit at any unique temperature or sets of temperatures that are particularly useful for the safe and effective storage of a variety of foods such as meats, poultry and dairy products for example. Additionally, if desired, the storage unit can simply be maintained at the temperature prevailing in the fresh food section.

The holding compartment 20 includes a first opening or opening structure 24 through which air may be introduced into the interior 22 of the holding compartment from the top of the rear wall 23 of the holding compartment as shown by the several directional arrows 25. In the illustrated embodiment, the opening structure 24 is shown as arranged across substantially the entire length of the back wall 23 of the holding compartment 20 but the opening structure can occupy a single narrower stretch or several such stretches of the length of the back wall. A second opening 26 is provided in a side wall 21 of the holding compartment adjacent the rear wall 23 of the holding compartment and above the bottom wall 27 of the holding compartment through which air may be discharged from the interior 22 of the holding compartment 20 as shown by the directional arrow 27. More than one such opening can be provided, and the single or multiple openings can be located at various locations in the holding compartment.

As will become apparent from the description that follows, the flow of air through the first opening 24 into the interior 22 of the holding compartment 20 and the flow of air from the interior 22 through the second opening 26 are managed in a way to control the temperature of the interior of the holding compartment and the articles placed within the holding compartment. Also, as described below, there is a circumstance where the discharge of air through the second opening 26 is precluded so that air introduced through the first opening 24 will be discharged from the open top of the holding compartment 20. In other words, in the illustrated embodiment, the cover for the holding compartment 20 does not seal off entirely the interior 22 of the holding compartment and air is able to be discharged from the interior 22 at the open spaces that exist between the cover and the top perimeter of the holding compartment 20.

Turning now to a description of the air-handling unit 30, as shown in FIGS. 2 through 5, the air-handling unit is located at the rear of the holding compartment 22 and in the illustrated embodiment comprises a housing made up of a forward portion 31 in which the various components of the air-handling unit are housed and a rearward portion 33 that closes off the forward portion 31. The air-handling unit 30 in the illustrated embodiment remains in the fresh food section when the holding compartment 20 is withdrawn from the fresh food section.

The air-handling unit 30 includes a plenum 32 that is in air flow communication with the interior 22 of the holding compartment 20 through the first opening structure 24 in the holding compartment, whereby air may be delivered from the plenum 32 to the interior of the holding compartment. More particularly, there are provided in the air-handling unit passageways 34, separated by vanes 35 that form an air distribution manifold 37 at the top of the air-handling unit. The manifold 37 engages the first opening structure 24 in the holding compartment 20 and places the plenum 32 in air flow communication with the first opening 24 in the holding compartment. For illustrative purposes, the holding compartment 20 in FIG. 2 is shown as not entirely replaced into the fresh food section so that the first opening 24 and the air distribution manifold can be more clearly seen. When the holding compartment is returned all the way to the interior of the fresh food section, the opening structure 24 in the holding compartment and the manifold 37 in the air-handling unit engage one another so that there is a minimum leakage of air at the jointure of the opening structure and the manifold.

The primary sources of air for the plenum 32 in the embodiment illustrated in the drawings are two and comprise air discharged from the interior 22 of the holding compartment 20 through second opening 26 in the side wall 21 of the holding compartment and cold air from the freezer section of the refrigerator. For the provisioning of cold air to the plenum 32 from the freezer section, the air-handling unit 30 includes an air inlet 36 that is located in the side wall 38 of the air-handling unit and is adapted to be placed into air flow communication with a source of cold air in the refrigeration appliance such as the cold air from the freezer section. Thus, in the illustrated embodiment, the storage unit 10 is adapted to be used with a so-called side-by-side refrigerator where the fresh food section and the freezer section are arranged side-by-side as is familiar to those of ordinary skill in the art. In that configuration, the air inlet 36 is aligned with an opening in the mullion or wall that separates the fresh food section and the freezer section so that cold air from the freezer section can flow from the freezer section, through the opening in the wall that separates the fresh food section and freezer section and through the inlet 36 to the interior of the air-handling unit 30. Of course, the invention is not limited to being used in a side-by-side refrigerator but can be used in other configurations such as for example where the freezer section is located below the fresh food section. In that case, the cold air from the freezer section is directed to the inlet 36 by appropriate ductwork in a manner that will be familiar to those of ordinary skill in the art.

A first air flow passageway 40 in the air-handling unit that is open to the air inlet 36 serves to place the air inlet in air flow communication with the plenum 32 through controlled opening 42 at a first location in the air-handling unit between inlet 36 and plenum 32. Thereby, air from a source of cold air in the refrigeration appliance, such as cold air from the freezer section of the refrigerator, can be selectively delivered to the interior 22 of the holding compartment 20 through the air inlet 36 and the first location 42 and plenum 32 that are in air flow communication with the interior 22 of the holding compartment 20. In the illustrated embodiment, the first air flow passageway 40 is the only passageway in the air-handling unit 30 that places the source of cold air in the refrigerating appliance in direct air flow communication with the air-handling unit. Cold air is selectively delivered by means of the operation of the controlled opening 42 as is described in greater detail below.

Figure 3:
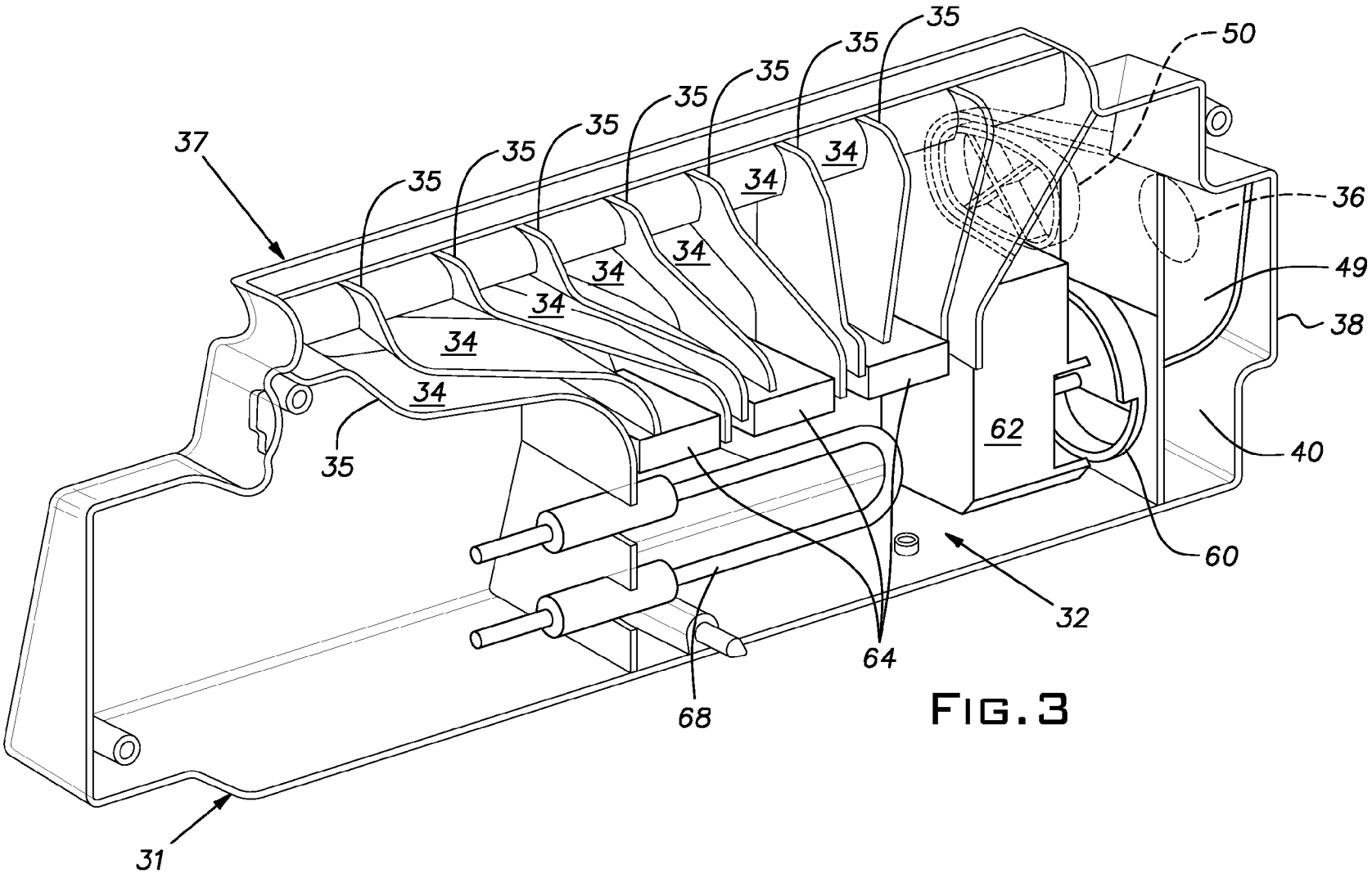
FIG. 3 is a perspective view of the air-handling unit of the embodiment of the storage unit of FIG. 1 as seen from the rear of the air-handling unit with the rear closure plate of the air-handling unit removed to expose the internal components of the air-handling unit.
Figure 4:
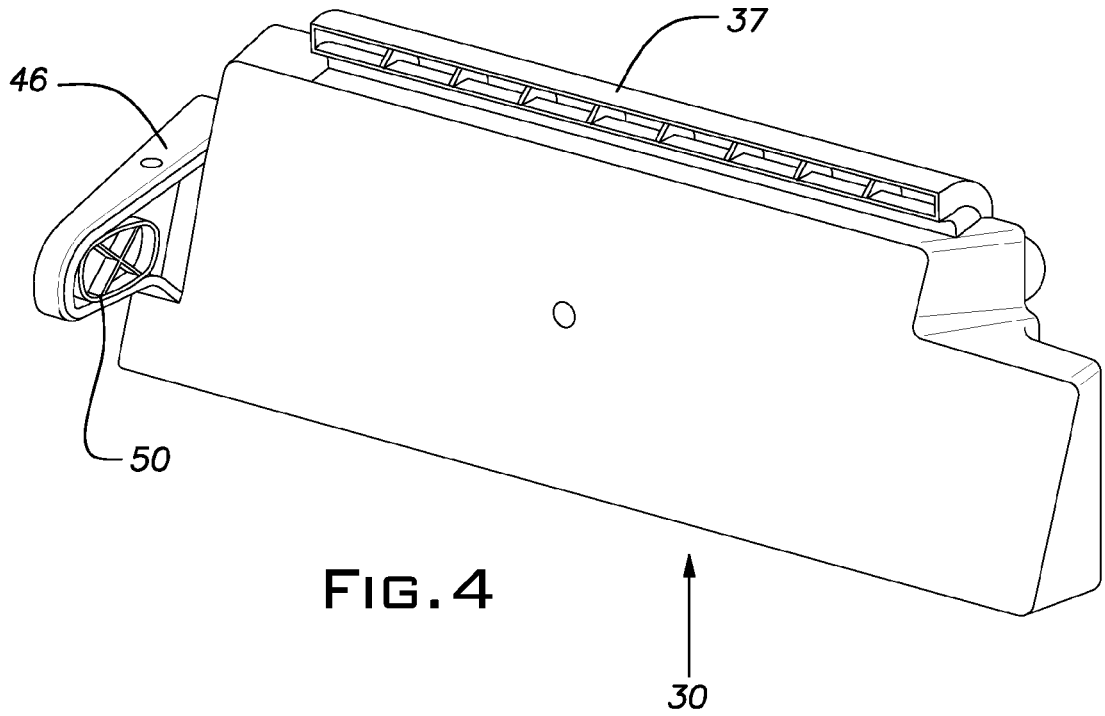
FIG. 4 is a perspective view of the air-handling unit of the storage unit shown in FIG. 3 as seen from the front side of the air-handling unit that engages the holding compartment of the storage unit.
Figure 5:
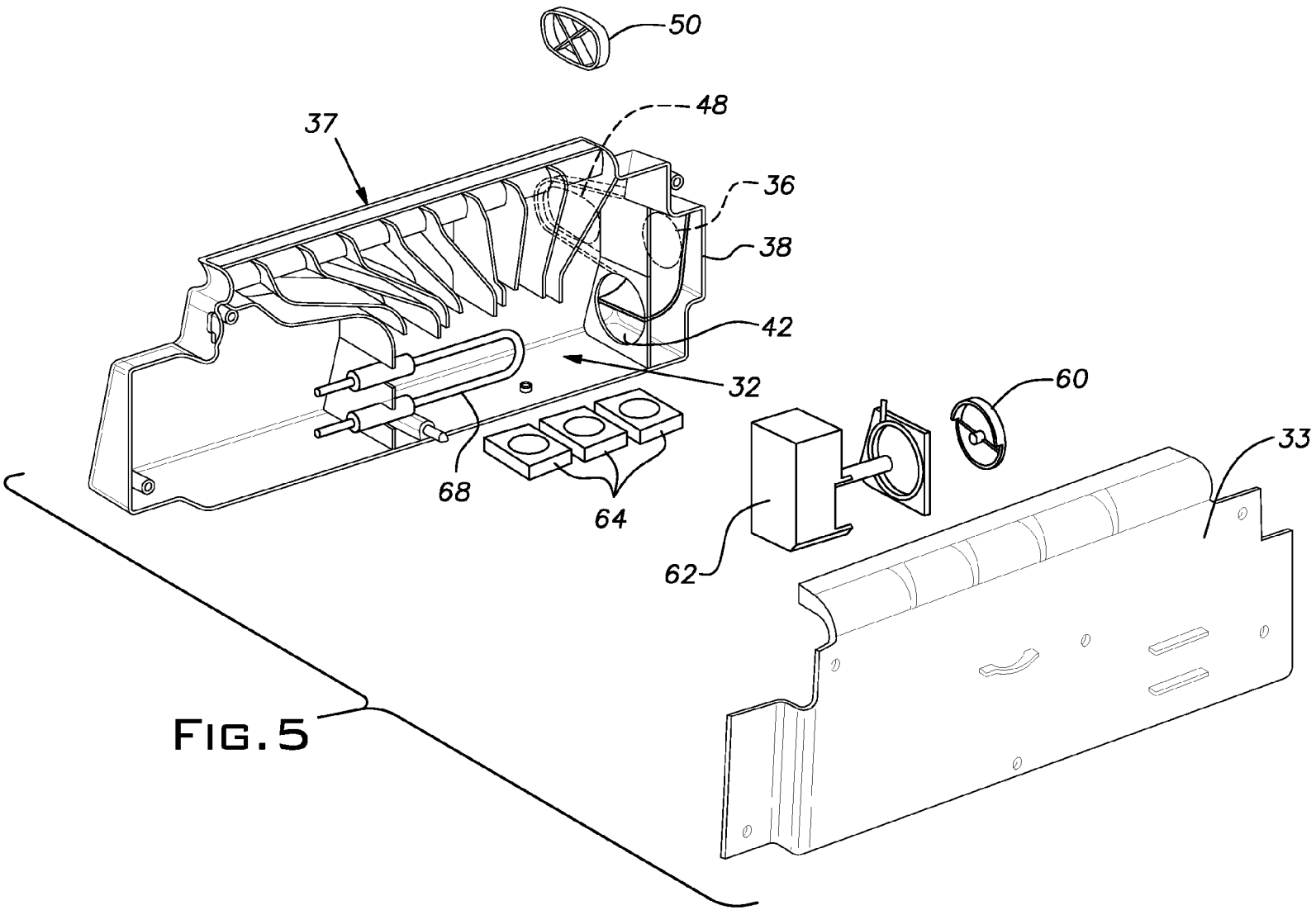
FIG. 5 is an exploded perspective view of the air-handling unit of the storage unit shown in FIGS. 3 and 4 as seen from the rear of the air-handling unit.

Referring now in greater detail to FIGS. 3 through 5 of the drawings, a horn-shaped extension portion 46 of the air-handling unit 30 is shown. The extension portion 46 projects away from the air-handling unit in the direction of the holding compartment 20 and includes an opening 48 to the interior of the extension portion 46. The extension portion 46 comprises a passageway 49 through which air may flow to the plenum 32. The opening 48 is located in the extension portion 46 such that when the holding compartment 20 is in place in the fresh food compartment, the opening 48 is aligned with the second opening 26 in the side wall 21 of the holding compartment so that air flowing through the second opening can pass through the opening 48 in the extension portion and into the passageway 49 in the extension portion. A spring-loaded seal 50 is mounted at the opening 48 in the extension portion 46 and is biased outwardly of the opening 48 so that the seal 50 will firmly engage the outside of the side wall 21 of the holding compartment around the second opening 26, whereby air flowing through second opening 26 from the interior 22 of the holding compartment will not be able to escape but will pass through the opening 48 and into the passageway 49 in the extension portion 46.

Passageway 49 comprises a second air flow passageway that is in air flow communication with the second opening 26 in the holding compartment 20 for placing the second opening 26 in air flow communication with the plenum 32 through controlled opening 42 at the first location in the air-handling unit. Thereby, air discharged from the interior of the holding compartment may be selectively recirculated to the interior 22 of the holding compartment 20 through the second air flow passageway 49 and the first location 42 and plenum 32 which are in air flow communication with the interior 22 of the holding compartment 20. Recirculated air is selectively recirculated by means of the operation of the controlled opening 42 as is described in greater detail below.

From the foregoing description, it will be understood that the interior 22 of the holding compartment 20 is adapted to be placed in air flow communication with the freezer section of the refrigerator, whereby air from the freezer section may be delivered to the interior 22 of the holding compartment. It will also be understood that the structure described above provides an air flow passageway 49 for recirculating air discharged from the interior 22 of the holding compartment 20 back to the interior of the holding compartment through the plenum 32, the passageway 34 and the opening 24.

The air flow passageway 49 that delivers recirculating air to the controlled opening 42 is constructed so that the passageway 49 is in air flow communication with and discharges only into a first portion, such as one-half of the cross-sectional area, of the opening or first location 42, such as the top one-half portion of the opening 42 for example. Correlatively, air flow passageway 40 that delivers cold air to the controlled opening 42 is constructed so that the passageway 40 is in air flow communication with and discharges cold air only to a second portion, such as one-half of the cross-sectional area, of the opening or first location 42, such as the bottom one-half of the opening 42 for example.

A mixing valve 60 is located at the opening 42 and serves to control the amounts of cold air from duct 40 and recirculated air from duct 49 that are admitted to the plenum 32. Consequently, the storage unit 10 includes an air flow control device 60 that is configured for controlling the amounts of air from the freezer section of the refrigerator and recirculated air from the interior 22 of the holding compartment 20 that are delivered to the interior 22 of the holding compartment. More specifically, the illustrated embodiment includes a valve arrangement such as the mixing valve 60 that comprises a semi-circular or D-shaped valve whereby one-half of the opening 42 will always be closed off and one-half of the opening 42 will always be open. The mixing valve 60 is connected to a driver such as a servo-mechanism 62, for example, that rotates the valve at the opening 42, whereby different portions of the opening may be selectively open to the plenum 32. Thus, for example, the mixing valve 60 can be rotated to a position where only cold air is admitted through the opening 42 into the plenum 32 through the passageway 40. Alternatively, the mixing valve 60 can be rotated to a position where only recirculated air is admitted through the opening 42 into the plenum 32 through the passageway. The valve 60 also can be rotated to varying positions where both cold air and recirculated air are admitted through the opening 42 in varying amounts. Consequently, the air flow control device 60 selectively controls the flow of air from the first air flow passageway and the second air flow passageway to the holding compartment, with the air flow control device being configured to control the flow of air to the holding compartment to essentially only air from the source of cold air, essentially only air discharged from the interior of the holding compartment and essentially only mixtures of air from the source of cold air and air discharged from the interior of the holding compartment in selectively varying amounts. In those cases where both cold air, such as from the freezer section of a refrigerator, and recirculated air are admitted through the opening 42 and into the plenum 32, the plenum serves as a mixing area for the cold air from the freezer section of the refrigerator and recirculated air from the interior 22 of the holding compartment 20. The two air flows may be mixed in the mixing area in selected quantities as established by the selective positioning of the mixing valve 60, with the mixing area being in air flow communication with the interior of the holding compartment. Thus, the air flow control device controls the relative amounts of air from the first air flow passageway 40 and the second air flow passageway 49 that flow to the mixing area.

From the foregoing description it will be understood that with respect to the embodiment shown in the drawings, mixing valve 60 comprises an air flow control device for controlling the flow of air from the source of cold air in a refrigeration appliance, such as the freezer section of a refrigerator for example, to the plenum 32 through the first air flow passageway 40 and the flow of air from the second opening 26 in the holding compartment 20 to the plenum 32 through the second air flow passageway 49. And as described above, the air flow control device 60 controls the air flow to the plenum 32 whereby essentially only air from the source of cold air, essentially only air discharged from the interior of the holding compartment and essentially only mixtures of air from the source of cold air in the refrigeration appliance and air discharged from the interior 22 of the holding compartment 20 may selectively flow to the plenum 32 and be delivered from the plenum to the interior 22 of the holding compartment 20 through the first opening 24 in the holding compartment. Stated otherwise, all three circumstances are possible with the subject invention, but only one of the three possibilities can be implemented at any instant. It is in this respect that air from the source of cold air, air discharged from the interior of the holding compartment and mixtures thereof may selectively flow to the plenum 32. Thus, the air flow control device 60 is configured to selectively close off only the first portion of the opening 42 in the air-handling unit, close off only the second portion of the opening 42 and simultaneously close off sectors of both the first portion and second portion of the opening 42.

In those instances where the mixing valve 60 is open only to the flow of air from the source of cold air and is closed to the flow of air from the interior of the holding compartment through passageway 49, it will be understood that air introduced into the interior 22 of the holding compartment 20 must be provided with a way to exit the holding compartment. As indicated above, in the circumstance where the discharge of air through the second opening 26 is precluded, air introduced through the first opening 24 into the interior of the holding compartment will largely be discharged from the open top of the holding compartment 20 since the air-handling unit does not include a passageway for air to flow from the air-handling unit directly back to the source of cold air in the refrigeration appliance. That is, in the described embodiment, the cover for the holding compartment 20 does not seal off the interior 22 of the holding compartment and air is able to be discharged from the interior 22 of the holding compartment at the open spaces that exist between the cover and the top perimeter of the holding compartment. Thus, the interior of the holding compartment 20 is open to the interior of section of the refrigeration appliance in which the holding compartment is contained so that air from the interior 22 of the holding compartment 20 may be discharged to the interior of the refrigeration appliance and through the second opening 26 in the holding compartment, depending on whether or not the air flow control device 60 is positioned to allow air discharged through second opening 26 into passageway 49 to flow to the plenum 32.

Alternatively, a sealing arrangement can be provided so that the cover for the holding compartment 20 and the perimeter of the top of the holding compartment are sealed where they engage one another. In that case, an auxiliary opening can be provided in the holding compartment 20 whereby air can be discharged from the interior 22 of the holding compartment to the interior of the fresh food compartment for example.

Referring now to FIGS. 2, 3 and 5, there is best shown in those figures an air mover 64 located in the air handling unit 30 for moving air from the source of cold air, such as the freezer section of a refrigerator, to the plenum 32 through the air inlet 36 and first air flow passageway 40; for moving air discharged from the interior 22 of the holding compartment 20 to the plenum 32 through the second air flow passageway 49; and for delivering air from the plenum 32 to the interior 22 of the holding compartment 20 through the first opening 24 in the holding compartment. Stated otherwise, the storage unit 10 includes an air mover 64 for moving air from the freezer section of the refrigerator to the interior 22 of the holding compartment 20 and for recirculating air from the interior 22 of the holding compartment 20 back to the interior of the holding compartment. In the embodiment of the drawings, the air mover 64 comprises a fan assembly consisting of three fans arranged across the entry ends of the passageways 34. Of course, it is not necessary to use three fans and a fewer or greater number of fans can be employed and the term fan assembly is used herein to refer to any number of individual fans.

The fan assembly 64 can be such that that it is operable so that the rate at which air is moved by the fan may be adjusted, thereby adjusting the rate at which the thermal content of the air is delivered to the interior 22 of the holding compartment 20. For example, where the objective is to quickly cool articles in the holding compartment 20, and only cold air is being admitted to the plenum 32 by the air flow control device 60, the speed of the fan assembly can be increased in a manner familiar to those of ordinary skill in the art so that cold air is more rapidly delivered to the interior 22 of the holding compartment 20 and the articles more rapidly cooled thereby.

The storage unit also can include a heating device 68 located in or adjacent the plenum 32 of the air-handling unit 30 for selectively heating and increasing the temperature of the air delivered from the plenum 32 to the interior 22 of the holding compartment 20. Further, the heating device 68 can be operable so that the amount of heat transferred to the air delivered to the interior of the holding compartment is adjusted. For example, where the objective is to quickly thaw frozen articles in the holding compartment 20, and only recirculated air is being admitted to the plenum 32 by the air flow control device 60, the heating device 68 can be energized so as to increase the temperature of the air delivered to the interior of the holding compartment. And in those cases where it is desired to have the thawing process proceed more quickly, the heating device 68 can be energized to a greater degree in a manner known to those of ordinary skill in the art. The use of the heating device, however, is not limited to those instances where only recirculated air is being admitted to the plenum 32, and the heating device can also have application in cases where air from the freezer section is being admitted to the plenum 32.

Figure 6:
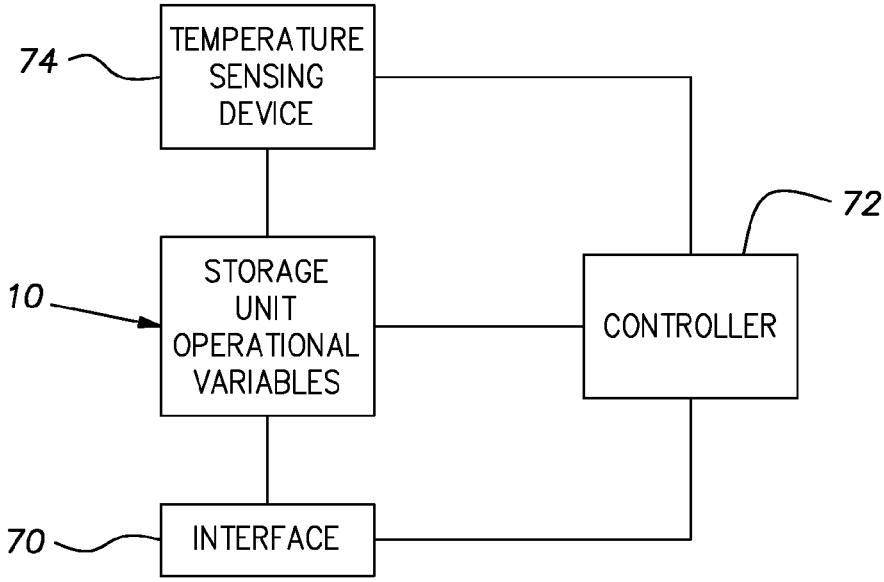
FIG. 6 is a schematic illustration of an assembly that can be employed to control the temperature of an embodiment of the storage unit of the invention.

It will be understood based on the foregoing description that the operational variables of the positioning of the air flow control device 60, the rate at which air is delivered to the interior of the holding compartment 20 by the fan assembly 64 and the amount of heat that is delivered to the air by the heating device 68 permit the temperature of the air delivered to the interior of the holding compartment to be variously adjusted by controlling these operational variables. For that purpose, an electronic controller 72 illustrated schematically in FIG. 6 can be provided for controlling the operational variables of at least one of the fan assembly 64, the air flow control device or valve arrangement 60 and the heating device 68. Further, the storage unit 10 can be provided with a temperature sensing device such as a thermistor or thermocouple 74, for example, illustrated schematically in FIG. 6 for providing an indication of the temperature at the interior 22 of the holding compartment 20. And the information from the temperature sensing device can be input to the controller so that the controller will control the operational variables of the fan, valve arrangement and heating device taking into account the information from the temperature sensing device.

The embodiment of the storage unit 10 shown in the drawings also includes a user interface 70 that provides a group of available temperature-control procedures from which a user may select a temperature-control procedure for application to the interior 22 of the holding compartment 20. In a particular aspect, the available temperature-control procedures comprise a temperature control procedure wherein essentially only air from the freezer section of the refrigerator is delivered to the interior 22 of the holding compartment 20, a temperature-control procedure wherein essentially only recirculated air from the interior 22 of the holding compartment 20 is delivered to the interior of the holding compartment and a temperature-control procedure wherein essentially only a mixture of air from the freezer section of the refrigerator and recirculated air from the interior 22 of the holding compartment 20 is delivered to the interior of the holding compartment.

With a user interface as described, the controller can be employed for controlling the implementation of the temperature-control procedure selected by the user as will be familiar to those having ordinary skill in the art. In one aspect, the controller can be employed for controlling the operational variables of at least one of the fan assembly 64, the air flow control device 60 and the heating device 68 in response to the temperature-control procedure selected by the user at the user interface. In another aspect, the controller can be employed for controlling the operational variables of at least one of the fan assembly 64, the air flow control device 60 and the heating device 68 in response to both the temperature-control procedure selected by the user at the user interface and the temperature sensed by the temperature sensing device. Such arrangements are shown schematically in FIG. 6.

It will be understood by those having ordinary skill in the art that the controller can be suitably programmed with appropriate algorithms or the like that take into account the several variables in the operation of the storage unit 20 in relation to the indicated temperature of the holding compartment 20 and the temperature-control procedure selected by the user at the user interface so that the controller will implement those algorithms to control the temperature of the storage unit as desired.

While the invention has been described with reference to specific embodiments and aspects, persons skilled in the art will understand that the invention can be practiced with modifications and variations within the spirit and scope of the claims that follow.

The invention claimed is:

1. A storage unit for a refrigeration appliance having a source of cold air, the storage unit comprising:

(a) a holding compartment having an interior for holding one or more articles a temperature of which is to be controlled, the holding compartment including a first opening through which air is introduced into the interior of the holding compartment and a second opening through which air is discharged from the interior of the holding compartment; and (b) an air-handling unit comprising:

(i) a plenum in air-flow communication with the interior of the holding compartment through the first opening in the holding compartment, whereby air is delivered from the plenum to the interior of the holding compartment;

(ii) an air inlet in air flow communication with the source of cold air in the refrigeration appliance;

(iii) a first air flow passageway in air flow communication with the air inlet and selectively in air flow communication with the plenum, whereby air from the source of cold air in the refrigeration appliance is selectively delivered through the air inlet to the plenum;

(iv) a second air flow passageway in air flow communication with the second opening in the holding compartment and selectively in air flow communication with the plenum separate from the first air flow passageway and from the source of cold air, whereby air discharged from the interior of the holding compartment to the second air flow passageway through the second opening in the holding compartment is selectively recirculated to the plenum;

(v) an air flow control device located in the first air flow passageway and the second air flow passageway and controlling the flow of air from the source of cold air in the refrigeration appliance to the plenum through the first air flow passageway and the flow of air from the second opening in the holding compartment to the plenum through the second air flow passageway; and (vi) a controller operatively connected to the air flow control device and controlling the operation of the air flow control device to selectively allow all of three air flows comprising essentially only air from the source of cold air, essentially only air discharged from the interior of the holding compartment and air from both the source of cold air in the refrigeration appliance and air discharged from the interior of the holding compartment to flow to the plenum through the air flow control device and be delivered from the plenum to the interior of the holding compartment through the first opening in the holding compartment, only one of the three air flows occurring at any one time.

2. The storage unit of claim 1 including an air mover located in the air-handling unit, in air flow communication with the source of cold air, the plenum, the air inlet and the first air flow passageway for moving air from the source of cold air to the plenum through the air inlet and first air flow passageway, in air flow communication with the second opening in the holding compartment, the plenum and the second air flow passageway for moving air discharged from the interior of the holding compartment through the second opening in the holding compartment to the plenum through the second air flow passageway, and in air flow communication with the plenum, the interior of the holding compartment and the first opening in the holding compartment for delivering air from the plenum to the interior of the holding compartment through the first opening in the holding compartment.

3. The storage unit of claim 2 including a heating device in air flow communication with air delivered from the plenum to the interior of the holding compartment for selectively heating and increasing the temperature of the air delivered from the plenum to the interior of the holding compartment.

4. The storage unit of claim 3 wherein the air mover comprises a fan assembly.

5. The storage unit of claim 4 wherein the fan assembly is operable so that the rate at which air is moved by the fan assembly may be adjusted and the heating device is operable so that the amount of heat transferred to the air may be adjusted.

6. The storage unit of claim 5 including a temperature sensing device for providing an indication of the temperature at the interior of the holding compartment.

7. The storage unit of claim 6 including a user interface providing a group of available temperature-control procedures from which a user may select a temperature-control procedure for application to the interior of the holding compartment.

8. The storage unit of claim 7 wherein the controller controls the operation of the air flow control device and the operational variables of at least one of the fan and the heating device in response to the temperature-control procedure selected by the user at the user interface and the temperature indicated by the temperature-sensing device.

9. The storage unit of claim 1 wherein the refrigeration appliance includes a fresh food compartment in which the storage unit is located and the interior of the holding compartment is open to the interior of the fresh food compartment whereby air from the interior of the holding compartment is separately discharged both to the interior of the fresh food compartment and through the second opening in the holding compartment.

10. The storage unit of claim 1 wherein the second air flow passageway in air flow communication with the second opening in the holding compartment and selectively in air flow communication with the plenum is configured to discharge air from the interior of the holding compartment only to the plenum and not to the source of cold air.

11. A storage unit whose temperature may be controlled to selectively quickly chill and thaw articles placed within the storage unit, the storage unit being adapted to be located in the fresh food section of a refrigerator having a freezer section and comprising:

a holding compartment having an interior for holding one or more articles a temperature of which is to be controlled and configured so as to selectively quickly chill and thaw articles placed within the holding compartment, the interior of the holding compartment selectively in air flow communication with the freezer section of the refrigerator whereby air from the freezer section is selectively delivered to the interior of the holding compartment;

an air flow passageway configured for selectively recirculating air discharged from the interior of the holding compartment back to the interior of the of the holding compartment, the selective recirculation of air discharged from the interior of the holding compartment back to the interior of the holding compartment occurring selectively separately from air from the freezer section and together with air from the freezer section;

a mixing area where air from the freezer section of the refrigerator and recirculated air from the interior of the holding compartment is selectively mixed in selected quantities, the mixing area being in air flow communication with the interior of the holding compartment; and a user interface providing a group of available temperature-control procedures from which a user may select a temperature-control procedure for application to the interior of the holding compartment, the available temperature-control procedures comprising all of three temperature-control procedures including a temperature-control procedure wherein essentially only air from the freezer section of the refrigerator is delivered to the interior of the holding compartment, a temperature-control procedure wherein essentially only recirculated air from the interior of the holding compartment is delivered to the interior of the holding compartment and a temperature-control procedure wherein essentially only a mixture of air from the freezer section of the refrigerator and recirculated air from the interior of the holding compartment is delivered to the interior of the holding compartment, only one of the three temperature-control procedures occurring at any one time.

12. The storage unit of claim 11 including a controller operably associated with the user interface for controlling the implementation of the temperature-control procedure selected by the user.

13. The storage unit of claim 11 including an air mover in air flow communication with the freezer section of the refrigerator and the interior of the holding compartment for moving air from the freezer section of the refrigerator to the interior of the holding compartment and for recirculating air from the interior of the holding compartment back to the interior of the holding compartment.

14. The storage unit of claim 13 wherein the air mover comprises a fan assembly.

15. The storage unit of claim 11 including a heating device in air flow communication with the air delivered to the interior of the holding compartment for selectively heating and increasing the temperature of the air delivered to the interior of the holding compartment.

16. The storage unit of claim 15 including an air mover in air flow communication with the freezer section of the refrigerator and the interior of the holding compartment for moving air from the freezer section of the refrigerator to the interior of the holding compartment and for recirculating air from the interior of the holding compartment back to the interior of the holding compartment.

17. The storage unit of claim 16 wherein the air mover comprises a fan assembly.

18. The storage unit of claim 11 including an air flow control device controlling the amounts of air from the freezer section of the refrigerator and recirculated air from the interior of the holding compartment that are delivered to the interior of the holding compartment.

19. The storage unit of claim 18 including an air mover in air flow communication with the freezer section of the refrigerator and the interior of the holding compartment for moving air from the freezer section of the refrigerator to the interior of the holding compartment and for recirculating air from the interior of the holding compartment back to the interior of the holding compartment.

20. The storage unit of claim 19 including a heating device in air flow communication with the air delivered to the interior of the holding compartment for selectively heating and increasing the temperature of the air delivered to the interior of the holding compartment.

21. The storage unit of claim 20 including a temperature sensing device for providing an indication of the temperature at the interior of the holding compartment.

22. The storage unit of claim 21 including a controller operably associated with the at least one of the fan, the air flow control device, the heating device, the temperature-sensing device and the user interface for controlling the operational variables of at least one of the fan, the air flow control device, and the heating device in response to the temperature-control procedure selected by the user at the user interface and the temperature sensed by the temperature-sensing device.

23. The storage unit of claim 11 wherein the airflow passageway is configured to recirculate air discharged from the interior of the holding compartment only back to the interior of the holding compartment and not to the freezer section.

24. A storage unit for a refrigeration appliance having a source of cold air, the storage unit including:

(a) a holding compartment having an interior, the holding compartment including a first opening through which air is introduced into the interior of the holding compartment and a second opening through which air is discharged from the interior of the holding compartment; and (b) an air-handling unit including:

(i) an air flow control device including a variable opening in air flow communication with the first opening in the holding compartment, and a valve located at the variable opening in the air flow control device and closing off air flow communication to the first opening in the holding compartment through a selected portion of the variable opening in the air flow control device comprising less than the entirety of the variable opening in the air flow control device;

(ii) a first air flow passageway in air flow communication with the source of cold air in the refrigeration appliance and the variable opening in the air flow control device; and (iii) a second air flow passageway in air flow communication with the second opening in the holding compartment and the variable opening in the air flow control device.

25. The storage unit of claim 24 wherein the second air flow passageway is configured to recirculate air from only the second opening in the holding compartment and the variable opening in the air flow control device.

26. The storage unit of claim 24 including a controller operatively connected to the air flow control device and controlling the operation of the air flow control device to selectively allow all of three air flows comprising essentially only air from the source of cold air, essentially only air discharged from the interior of the holding compartment and air from both the source of cold air in the refrigeration appliance and air discharged from the interior of the holding compartment to flow to the first opening in the holding compartment, only one of the three air flows occurring at any one time.

27. The storage unit of claim 26 including an air mover located in the air-handling unit and in air flow communication with the first air flow passageway, the second air flow passageway, the interior of the holding compartment and the first opening in the holding compartment for moving air through the first air flow passageway and through the second air flow passageway, and for delivering air from the air-handling unit to the interior of the holding compartment through the first opening in the holding compartment.

28. The storage unit of claim 27 including a heating device in air flow communication with the air delivered from the air-handling unit to the interior of the holding compartment for selectively heating and increasing the temperature of the air delivered from the air-handling unit to the interior of the holding compartment.

29. The storage unit of claim 24 wherein the valve is configured to selectively close off from air flow communication to the first opening in the holding compartment one of each of the entirety of the first air flow passageway, the entirety of the second air flow passageway and selected portions of both the first air flow passageway and the second air flow passageway.

30. The storage unit of claim 29 including a controller operatively connected to the air flow control device and controlling the operation of the air flow control device to selectively allow all of three air flows comprising essentially only air from the source of cold air, essentially only air discharged from the interior of the holding compartment and air from both the source of cold air in the refrigeration appliance and air discharged from the interior of the holding compartment to flow to the first opening in the holding compartment, only one of the three air flows occurring at any one time.

31. A storage unit for a refrigeration appliance having a source of cold air, the storage unit including:

(a) a holding compartment having an interior, the holding compartment including a first opening through which air is introduced into the interior of the holding compartment and a second opening through which air is discharged from the interior of the holding compartment; and (b) an air-handling unit including:

(i) a first air flow passageway in air flow communication with the source of cold air in the refrigeration appliance;

(ii) a second air flow passageway in air flow communication with the second opening in the holding compartment, the second air flow passageway being separate from the first air flow passageway and from the source of cold air; and (iii) an air flow control device located in the first air flow passageway and the second air flow passageway and selectively controlling the flow of air from the first air flow passageway and the second air flow passageway to the holding compartment, the air flow control device controlling the flow of air to the holding compartment to all of three air flows comprising essentially only air from the source of cold air, essentially only air discharged from the interior of the holding compartment and essentially only mixtures of air from the source of cold air and air discharged from the interior of the holding compartment in selectively varying amounts, only one of the three air flows occurring at any one time.

32. The storage unit of claim 31 including an air mover located in the air-handling unit and in air flow communication with the first air flow passageway, the second air flow passageway and the interior of the holding compartment for moving air through the first air flow passageway and through the second air flow passageway, and for the delivering air from the air-handling unit to the interior of the holding compartment.

33. The storage unit of claim 31 including a heating device in air flow communication with the air delivered from the air-handling unit to the interior of the holding compartment for selectively heating and increasing the temperature of the air delivered from the air-handling unit to the interior of the holding compartment.

34. The storage unit of claim 31, wherein the second air flow passageway in air flow communication with the second opening in the holding compartment separate from the first air flow passageway and from the source of cold air is excluded from air flow communication with the source of cold air.

* * * * *